United States Patent [19]

Pinchock

[11] 4,047,725

[45] Sept. 13, 1977

[54] TRUCK ASSEMBLY FOR A SKATE-LIKE DEVICE

[75] Inventor: Donald E. Pinchock, Blairsville, Pa.

[73] Assignee: Metcom Products Company, Blairsville, Pa.

[21] Appl. No.: 649,909

[22] Filed: Jan. 16, 1976

[51] Int. Cl.[2] ..... A63C 17/02

[52] U.S. Cl. ..... 280/11.28

[58] Field of Search ..... 280/87.04 A, 11.28, 280/11.27, 11.19, 11.26, 11.23

[56] References Cited

U.S. PATENT DOCUMENTS

| | | | |
|---|---|---|---|
| 218,035 | 7/1879 | Lash | 280/11.28 X |
| 322,504 | 7/1885 | Thompson | 280/11.28 |
| 329,556 | 11/1885 | Hirt | 280/11.28 |
| 2,180,062 | 11/1939 | Lee, Jr. et al. | 280/11.28 |
| 2,330,147 | 9/1943 | Rodriguez | 280/11.28 X |
| 2,552,035 | 5/1951 | Cooke et al. | 280/11.28 |
| 2,726,873 | 12/1955 | Wooley | 280/11.28 |
| 2,763,490 | 9/1956 | Crone | 280/11.28 |
| 2,920,899 | 1/1960 | Crone | 280/11.28 |

*Primary Examiner*—Joseph F. Peters, Jr.
*Assistant Examiner*—Milton L. Smith
*Attorney, Agent, or Firm*—Webb, Burden, Robinson, & Webb

[57] ABSTRACT

A truck assembly for a skate-like device includes a truck support having a mounting plate and a mounting bracket extending angularly outward therefrom. A truck is pivotally mounted to the mounting bracket so as to define an axis of rotation at an acute angle to the mounting plate. Resilient means are positioned along the axis of rotation in engagement with the truck so as to resist rotation of the truck relative to the truck support. An adjustment pin extends through this assembly so as to increase or decrease the pressure of the engagement of the resilient means to the truck. In the preferred embodiment, the means comprise a cam insert and a cam follower in which the cam insert is keyed to the truck and the cam follower moves in a direction along the axis of rotation and against a resilient pad.

11 Claims, 18 Drawing Figures

TRUCK ASSEMBLY FOR A SKATE-LIKE DEVICE

FIELD OF THE INVENTION

My invention relates to truck assemblies and, more particularly, to adjustable truck assemblies utilized with skateboards, skates, skooters or other skate-like devices.

DESCRIPTION OF THE PRIOR ART

The present skateboard craze has resulted in a number of different truck assemblies therefor. The present truck assemblies for skateboards include a plurality of support members connected to the mounting plate with an adjustment for turning positioned in a direction generally perpendicular to the mounting plate. Turning the skateboard is accomplished by shifting one's weight to an off-center position. This shifting of weight causes a torquing movement about the various supports. This twisting or torquing is resisted by rubber bushings positioned along the adjustable support column. A substantial amount of the rider's weight rests on the adjustment means.

Because of the resolution of forces about the axes of the various support members, a nonuniform and nonreproducible turning action results. In addition, the substantial amount of weight is on the rubber bushings to further make maneuvering difficult. Further, since turning is accomplished through a complex torquing and twisting movement, the presently used truck assemblies are subjected to hard wear. In effect, the forces are often concentrated on the adjustment bolt which may cause instability and low service life.

Attempts have been made with skates to construct trucks having a pure rotational movement about an axis of rotation at an acute angle to the skate itself. Exemplarly of such teachings are the Wooley U.S. Pat. No. 2,726,873 and the Lee, Jr. et al. U.S. Pat. No. 2,180,062. However, neither patent teaches an adjustment means operative along the axis of rotation and no means are provided to control the turning capability of the skates. It has also been proposed to use a cam-like arrangement between a spring and the pivot of roller skate joint. This is taught by Hurt U.S. Pat. No. 329,556. Such an arrangement as taught by Hurt would be cumbersome to build and would provide inadequate support for the rugged use presently given skateboards and the like. In addition, the movement of the cam is not in line with the axis of rotation. And further, such a construction would tend to place the wheels too far below the mounting plate thereby increasing the difficulty for rider balance.

SUMMARY OF THE INVENTION

My invention eliminates the torquing and twisting movements and resultant nonreproducible turning results by providing a single fixed axis of rotation about which the truck rotates. I have further taken the majority of the weight of the rider off of the adjustment means by placing the adjustment means along the axis of rotation which is at an acute angle to the mounting plate. This permits a more uniform, smooth performance and a reproducible turning action which the skater can rely upon. Since the axis of rotation is fixed, shock absorbing means and adjustment means can be utilized with maximum control of performance. This fixed axis of rotation further permits total insulation of the truck from the skateboard to minimize vibration and further permits a construction which can be adjustable to different axes of rotation.

My truck assembly includes a truck support having a mounting plate and a spaced flanged mounting bracket extending angularly outward from the mounting plate. The truck is pivotally mounted to the mounting bracket so as to define a fixed axis of rotation at an acute angle to the mounting plate. Means are positioned along the axis of rotation to resiliently engage the truck to resist rotation thereof. An adjustment pin extends along the axis of rotation to increase or decrease the pressure of the engagement of the resisting means against the truck. The preferred means includes a cam insert keyed to the truck so as to rotate therewith and a cam follower positioned in the cam insert so as to be movable in a direction along the axis of rotation and against a resilient pad.

My truck assemblies have particular application to skateboards. However, they could also be utilized on roller skates, skooters or other wheeled land vehicles for recreational or other uses.

Figure 1:
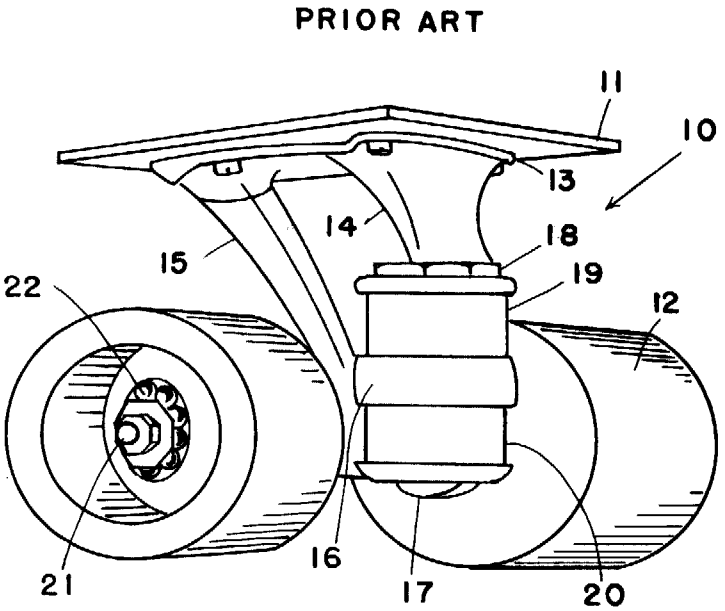
FIG. 1 is a perspective view illustrating the prior art truck assembly for a skateboard.

The typical prior art truck assembly for a skateboard is illustrated in FIG. 1. The prior art truck assembly, generally designated 10, includes a mounting plate 11 which is bolted to a skateboard, not shown. A mounting frame 13 in turn connects to the mounting plate 11 or it can be integral therewith. The mounting frame 13 forms part of the truck 16 which houses the axle 21 and the wheels 12. the wheels 12 are rendered easily turnable through bearings 22 positioned between the wheels 12 and the axle 21. The truck 16 includes support 14 extending at substantially right angles to the mounting frame 13 and support 15 which extends from the mounting frame 13 to the truck in the area of the axle 21. Support 15 is pivotably connected to the mounting frame 13. Shock absorbing and adjustment means are provided along the vertical support 14 by spaced resilient bushings 19 and 20 coaxially positioned and held in place by adjusting pin 17 which extends through the bushings into the support 14. Pin 17 is adjustably retained within support 14 by means of nut 18 adjacent the support 14. The two bushings 19 and 20 are maintained in space relationship by an annular part of the truck 16 which extends therebetween.

Figure 2:
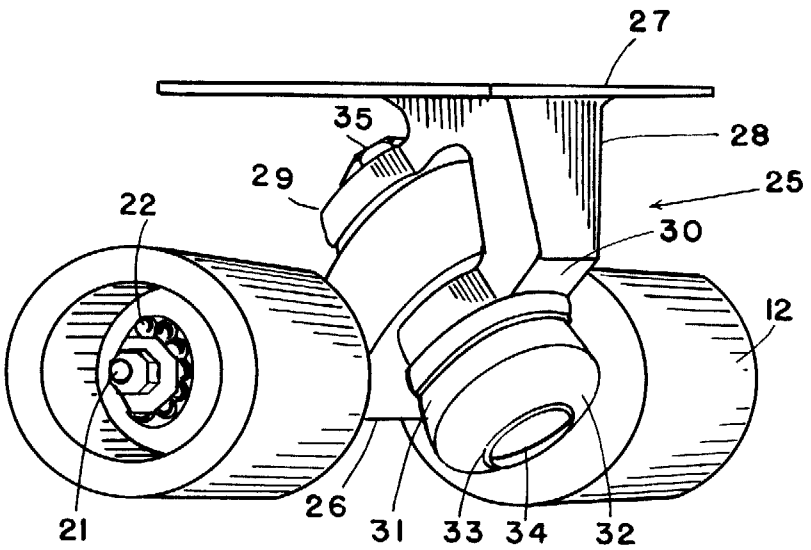
FIG. 2 is a perspective view illustrating my truck assembly.

My truck assembly, generally designated 25, is illustrated in FIG. 2. A mounting plate 27 is provided for connecting the truck assembly 25 to the skateboard, not shown. Integrally extending from mounting plate 27 is mounting bracket 28 which includes two parallel and spaced flanges 29 and 30. These flanges support the truck 26 which is positioned therebetween. Truck 26 houses the axle 21, bearings 22 and the wheels 12 in the standard manner. The various components of the truck assembly can be seen in FIG. 3.

The mounting plate 27 includes a U-shaped mounting bracket 28 comprised of flanges 29 and 30 having aligned openings 37 and 38, respectively, therethrough. Mounting bracket 28 is integral with the mounting plate 27 and is positioned so that the flanges 29 and 30 are at an acute angle thereto so that the openings 37 and 38 define the fixed axis of rotation, designated A in FIG. 3, as will be described hereinafter. Axis A is at an acute angle to the mounting plate 27. For skateboards this acute angle will be about 45°, whereas it will be about 30° when the truck assembly is used with roller skates.

Figure 3:
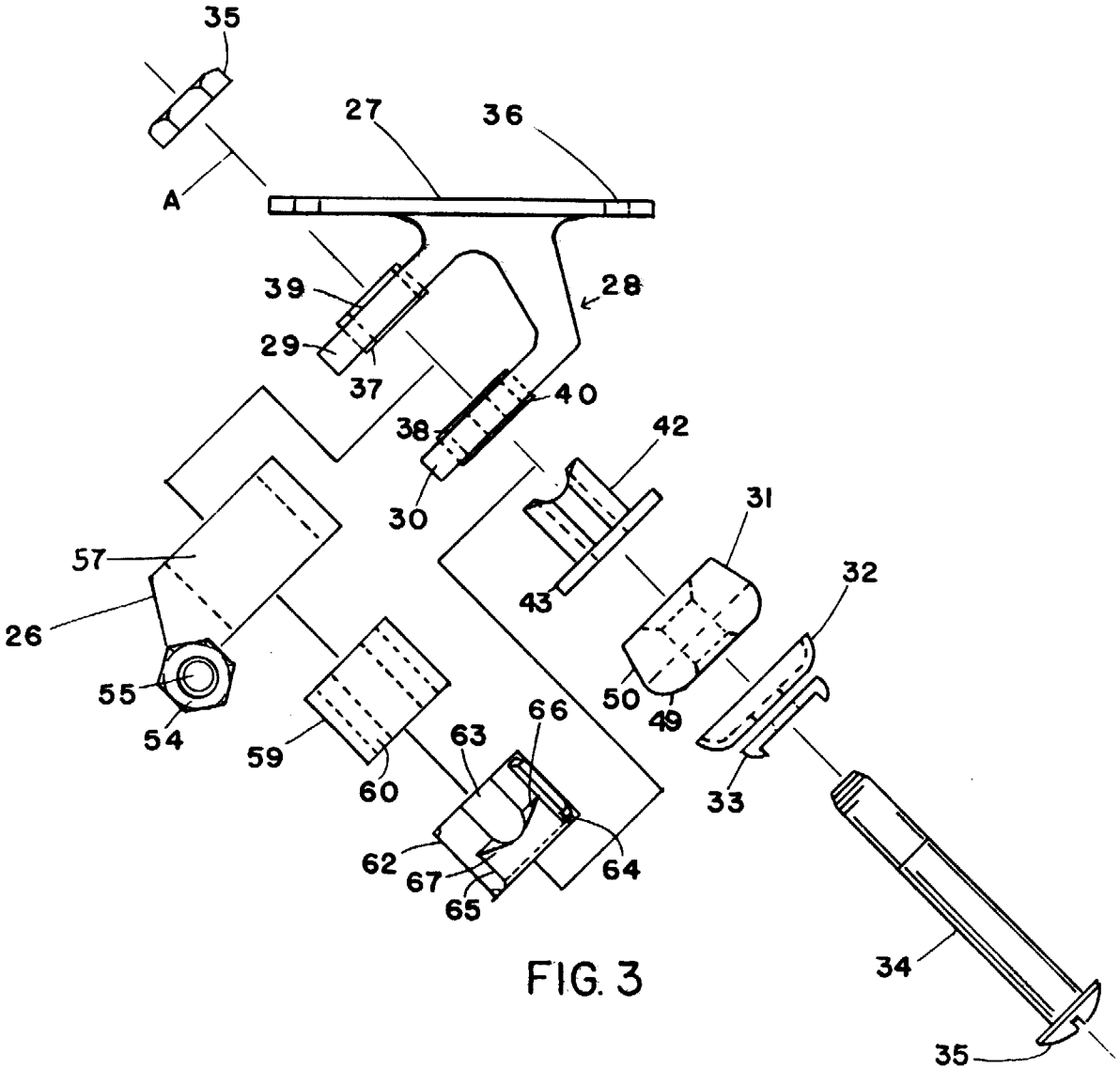
FIG. 3 is an exploded view showing the various components of my truck assembly.

Positioned within opening 37 in flange 29 is a threaded insert 39 which accommodates the adjusting pin 34, FIG. 3. A guide insert 40 is positioned within the opening 38 in flange 30 to guide the cam follower 42. Mounting plate 27 includes a plurality of spaced holes 36 through which fasteners secure the truck assembly to the skateboard or other skate-like device.

Figure 12:
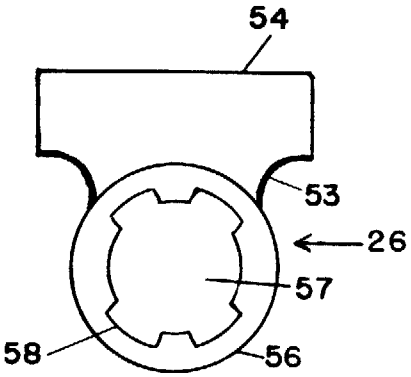
FIG. 12 is a plan view of the truck.

Positioned between flanges 29 and 30 is the truck 26. The truck 26 includes a truck housing 56 having an opening 57 extending therethrough in axial alignment with the axis of rotation A, FIG. 3. Truck 26 also includes an axle housing 54 connected to the truck housing 56 through connecting arm 53, FIG. 12. Axle housing 54 has an opening 55 therethrough to accommodate the axle 21, FIG. 3. The truck housing opening 57 includes four axially extending keyways 58 recessed into the wall of truck housing 56, FIG. 12.

Positioned within keyways 58 of truck housing 56 is an elastomeric, annular shock absorber in the form of bushing 59, FIG. 3. Bushing 59 includes four spaced, axially extending keys 60 which fit within the keyways 58, FIG. 8. The bushing 59 likewise includes a central opening 61 and four axially extending keyways 68 recessed into the bushing wall in the area of the keys 60.

Figure 5:
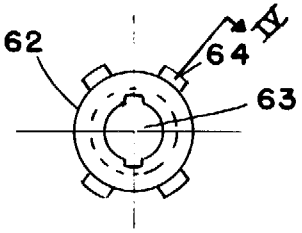
FIG. 5 is a plan view of the cam insert.
Figure 7:
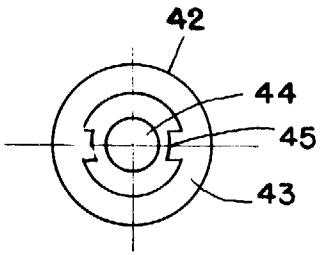
FIG. 7 is a plan view of the cam follower.
Figure 4:
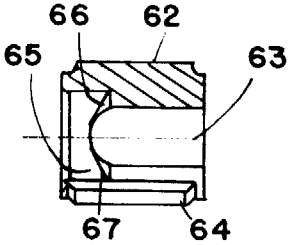
FIG. 4 is an elevation partly in section showing the cam insert.
Figure 8:
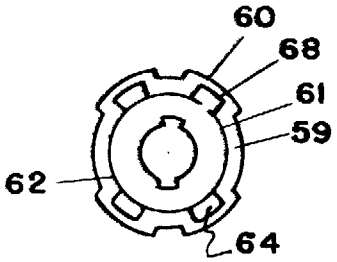
FIG. 8 is a plan view showing the elastomeric bushing positioned about the cam insert.
Figure 9:
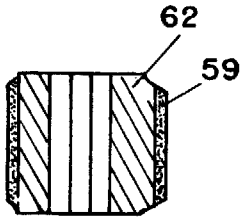
FIG. 9 is a section of the assembly of FIG. 8 taken through the longitudinal axis.

A cam insert 62 is positioned in mating engagement within the bushing 59, FIGS. 8 and 9. Cam insert 62 has a central opening 63 extending therethrough, FIGS. 4 and 5. a recess 65 extends inward from one end of cam insert 62 and that recess 65 terminates in two diametrically opposed arcuate cam surfaces 66 and 67, respectively. The outer surface of cam insert 62 includes four axially extending ribs 64 which matingly engage with the keyways 68 formed in the bushing 59, FIG. 8. Since cam insert 62 is keyed into bushing 59 which in turn is keyed into truck 26, rotation of truck 26 about the axis of rotation A likewise imparts rotation to cam insert 62.

Figure 6:
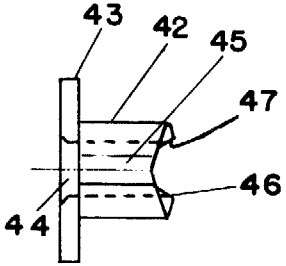
FIG. 6 is an elevation of the cam follower.

A cam follower 42 is positioned within the cam insert 62, FIG. 3. Cam follower 42 includes an enlarged annular head 43, FIG. 6. The body of cam follower 42 includes an axially extending opening 44. Cam follower 42 terminates at opposing cam following surfaces 46 and 47 which are shaped to matingly engage with the cam surfaces 66 and 67, respectively of the cam insert 62. Cam follower 42 likewise includes axially extending keyway recesses 45 which are engaged by keys (not detailed) of the guide insert 40, FIG. 3.

Figure 10:
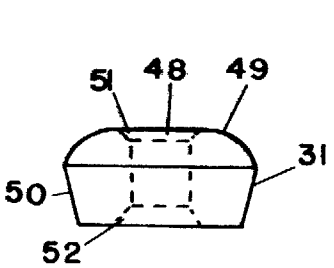
FIG. 10 is an elevation of the resilient pad.
Figure 11:
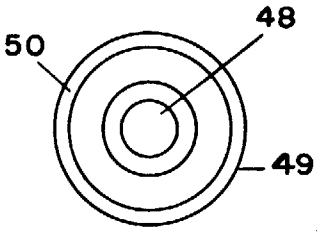
FIG. 11 is a plan view of the resilient pad.

Positioned against the enlarged cam follower head 43 is a resilient pad 31 normally made of hard rubber, FIG. 3. Pad 31 has a dome surface 49 and frustoconical sides 50 so that in section the sides form a trapezoid, FIGS. 10 and 11. Pad 31, which rests against enlarged cam follower head 43, provides the resistance for movement of the cam follower 42, as will be described hereinafter. Pad 31 has a central aperture 48 therethrough which includes chamfer 51 along the dome surface and chamfer 52 along the surface which engages the cam follower 42.

A recessed metal cap 32 matingly engages the dome surface 49 of pad 31 and a wear insert 33 made of a hard plastic like material such as the product sold under the trademark TEFLON is positioned adjacent cap 32, FIG. 3.

A bolt 34 having an enlarged bolt head 35 extends through the aligned central apertures of the various components described hereinbefore and threadably engages the threaded insert 39 and is thereafter locked by means of nut 35 positioned adjacent threaded insert 39.

My truck assembly works as follows. Bolt 34 is tightened to the desired adjustment level so as to force pad 31 against cam follower 42 All movement by the truck 26 is about the fixed axis of rotation A. As this movement of truck 26 takes place, cam insert 62 likewise rotates causing cam follower surfaces 46 and 47 of cam follower 42 to move along cam surface 66 and 67, respectively, so as to cause cam follower 42 to move in a direction along the axis of rotation A and out of the cam insert 62. The tighter the adjustment of adjusting pin 34, the more pressure is placed on cam follower 42 so as to resist rotation and make it more difficult to negotiate a turn. Of course, the converse is true and where it is desired to make frequent or sharp turns the pressure on the cam follower 42 can be reduced. Impacts on the wheel caused from hitting bumps and the like are absorbed by the elastomer bushing 59.

Figure 13:
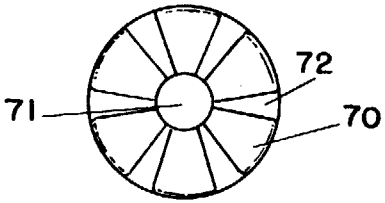
FIG. 13 is a modified form of the resilient pad.
Figure 14:
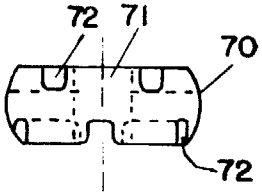
FIG. 14 is a plan view of the modified resilient pad of FIG. 13.

A modified resilient pad is illustrated in FIGS. 13 and 14. There pad 70 is toroidal in shape and includes a central opening 71 therethrough to accommodate the adjustment pin. The opposing surfaces which engage the cap 32 and the cam follower head 43, respectively, both include a plurality of recesses 72. As pressure is exerted by the adjusting pin these recesses 72 tend to lessen in volume or fill up with the resilient material thereby increasing the frictional contact with the cam follower 42 so as to make turning more difficult.

By restricting the movement of the truck about a fixed axis of rotation, several modifications can be made while still retaining the advantages resulting from the fixed axis of rotation and the adjustment positioned therealong.

Figure 17:
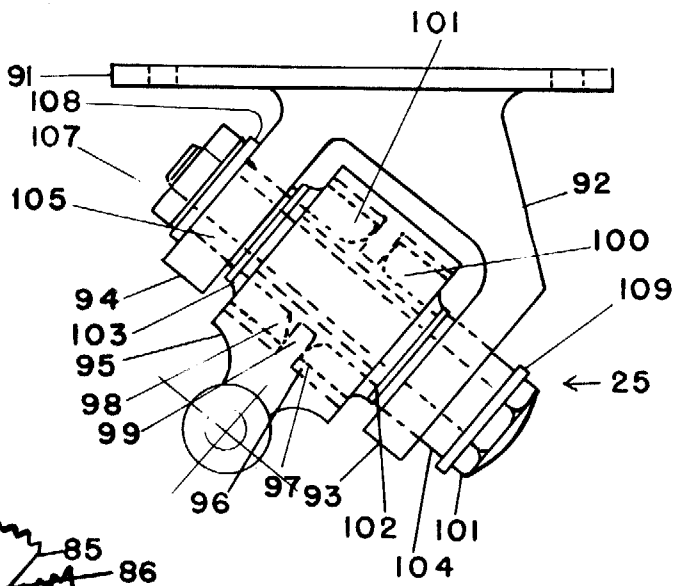
FIG. 17 is an elevation showing a further modified form of the invention.

A modified truck assembly 25 is illustrated in FIG. 17. Truck assembly 25 comprises a mounting plate 91 having an integral bracket 92 extending angularly therefrom. Bracket 92 comprises spaced flanges 93 and 94 which are respectively apertured so as to define the fixed axis of rotation as in the earlier embodiment. The truck 95 is positioned between the flanges 93 and 94. Truck 95 has an internal passageway 96 therethrough and an annular rib 99 extending into the internal passageway to define a first chamber 97 and a second chamber 98.

A first annular resilient pad 100 and a second annular resilient pad 101 are positioned in the first chamber 97 and second chamber 98, respectively. These annular pads abut the annular rib 99 along one surface and are bonded and interlocked to pressure plates 102 and 103, respectively, on their opposing surfaces.

A sleeve 104 extends through the flange 93 and abuts and is keyed to the pressure plate 102 and in the same manner annular sleeve 105 extends through flange 94 and abuts and is keyed to the pressure plate 103. Sleeve 104 also abuts a hard plastic washer 109 which in turn abuts adjustment pin 101. In a similar manner, sleeve 105 abuts a hard plastic washer 108 which in turn abuts nut 107 which is threaded on the adjustment pin 101. Tightening of adjustment pin 101 forces the sleeves 104 and 105 against the pressure plates 102 and 103, respectively, thereby forcing annular pads 100 and 101 against annular rib 99 and against the walls of the chambers 97 and 98. In this manner, rotation of truck 95 is resisted by the pressure placed upon the respective pads 101 and 100 and adjustment is made in the same manner as the earlier embodiment.

Figure 16:
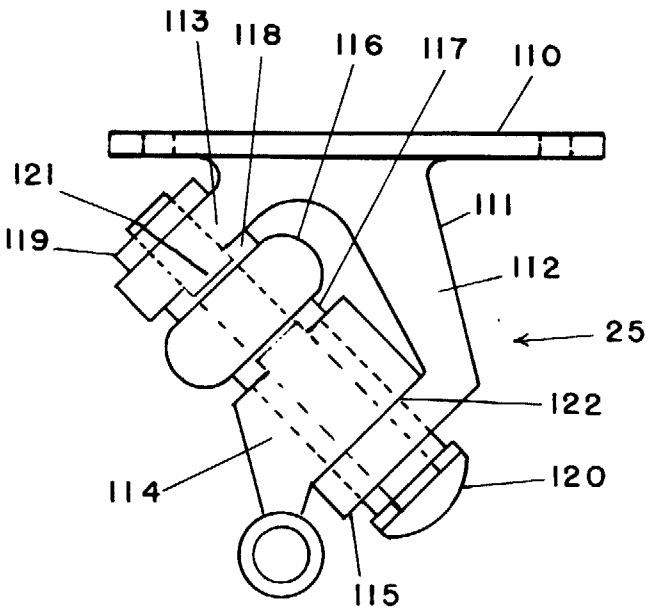
FIG. 16 is an elevation showing a modified form of the invention.

A singular toroidal shaped resilient pad 116 may also be employed to control the rotation of truck 114 about its fixed axis of rotation, FIG. 16. Specifically, mounting plate 110 has integral with it bracket 111 made up of flanges 112 and 113 which are spaced and apertured so as to define the axis of rotation as in the earlier embodiments. Truck 114 containing a central passageway 122 is positioned between the flanges 112 and 113. Resilient toroidal shaped pad 116 is bonded and keyed on one surface to apertured plate 117 and on the opposing surface to apertured plate 118. Pad 116 is positioned adjacent one end of the truck 114 and is keyed thereto through a key of the truck which engages a keyway of apertured plate 117. A sleeve 115 extends through the central passageway 122 and engages an internal lip (not shown) of the truck to permit the truck to tighten against the plate 117 to increase the twisting resistance of pad 116. In turn, plate 118 is keyed to key 121 which is an extension of flange 113. Bolt 120 extends through the entire assembly and tightening of the bolt 120 causes compression of the pad 116 through the exertion of the force placed on plates 117 and 118. Because the pad is keyed at one end to the truck 114 and into the bracket 111 on the other end, rotation of truck 114 is resisted by the pressure of pad 116. As long as the pad is keyed to both the truck and the bracket, it can be positioned between the flanges of the bracket or even outside of the flanges.

Figure 18:
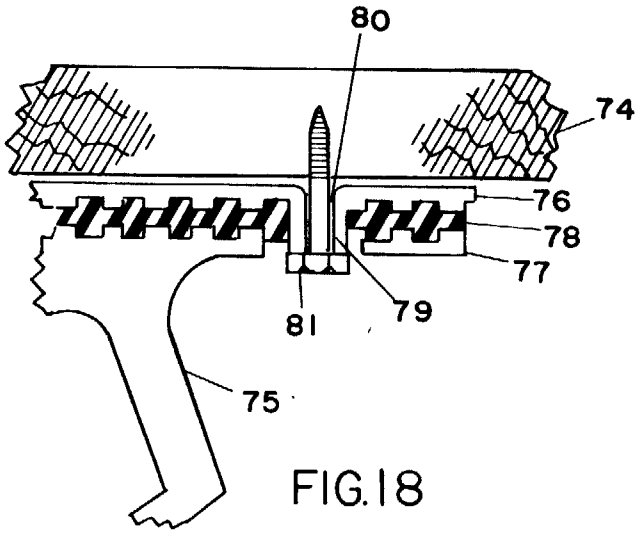
FIG. 18 is a fragmentary view showing a truck bracket mounted in isolation from the skateboard.

In FIG. 18, I have illustrated an embodiment wherein the mounting plate is secured to the skateboard independent of the bracket so that vibrations are absorbed within the mounting plate and not transmitted through the skateboard. Specifically, the mounting plate comprises a top plate 76 and a bottom plate 77 spaced but joined together through a resilient sheet 78 which is interlocked and bonded between plates 76 and 77. Extending outward from top plate 76 are a plurality of legs 79 having apertures 80 therethrough. Legs 79 are out of contact with plate 77 which is integral with mounting bracket 75. Fasteners 81 are positioned through leg 79 and into threadable engagement with skateboard 74. Vibrations of the mounting bracket 75 are dampened by the resilient sheet 78 and since fasteners 81 are out of contact with bracket 75, there is no direct transmission of the vibration from the truck, not shown, and bracket 75 to the skateboard 74.

Figure 15:
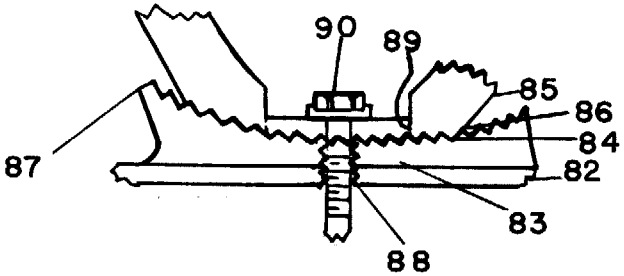
FIG. 15 is a fragmentary view showing a truck support with an adjustable axis of rotation.

The mounting bracket may also be made adjustable relative to the mounting plate so as to make the axis of rotation adjustable, FIG. 15. Specifically, mounting plate 82 is adapted to connect to the skateboard. Extending from mounting plate 82 is flange 83, the lower surface of which is concavely arcuate and which includes axially spaced teeth 84. A threaded opening 88 extends through flange 83 and mounting plate 82. Mounting bracket 85 also includes a flange 86 having a convexly arcuate surface with axially spaced teeth 87 which matingly engage flange 83. Flange 86 includes a slot 89 extending therethrough. A fastener 90 is positioned through slot 89 into threadable engagement with opening 88. Bracket 85 is movable within the length of slot 89 to arrive at the desired axis of rotation whereupon fastener 90 is tightened so that the teeth 87 of flange 86 of bracket 85 engage the mating teeth 84 of flange 83 of mounting plate 82. This embodiment therefore provides an adjustment for the angle of the fixed axis of rotation as well as a turning adjustment for rotation about the fixed axis of rotation as in the earlier embodiments.

I claim:

1. A truck assembly for a skate-like device comprising:

A. a truck support including a mounting plate and a mounting bracket extending angularly outward therefrom;

B. a truck adapted to accomodate axled wheels and pivotally mounted to the mounting bracket so as to define a fixed axis of rotation at an acute angle to the mounting plate, said truck having a central aperture therethrough;

C. means positioned along the axis of rotation and resiliently engaging said truck to resist rotation of the truck, said means including an annular insert positioned within the aperture of the truck and keyed thereto, said insert having at least one recessed cam surface, an annular cam follower extending into the insert and mating with the cam surface and a resilient pad positioned adjacent the cam follower whereby rotation of the truck and insert causes the follower to move along the cam surface in a direction along the axis of rotation and out of the insert, said movement being resisted by the pad; and D. an adjustment pin extending along the axis of rotation and through the bracket, the truck and the resisting means to increase or decrease the resilient engagement of the resisting means.

2. The assembly of claim 1 wherein the insert includes two cam surfaces diametrically positioned and the cam follower includes mating surfaces.

3. The assembly of claim 1 including a resilient annular shock absorbing bushing positioned between the truck and the annular insert.

4. A truck assembly for a skate-like device comprising:

A. a mounting plate adapted to connect the device;

B. a spaced dual flanged bracket extending angularly outward from the plate, said flanges having aligned openings defining a fixed axis of rotation at an acute angle to the mounting plate;

C. an apertured truck adapted to accommodate axled wheels and positioned between the flanges with its aperture in axial alignment with said openings, said truck adapted to rotate about the axis of rotation;

D. an annular cam insert positioned within the aperture of the truck and keyed thereto, said insert having at least one cam surface;

E. an annular cam follower positioned so as to extend into the annular insert and into mating relationship with the cam surface;

F. a resilient annular pad positioned against the cam follower; and

G. an adjustment pin extending through the flanges, truck, insert, follower and pad along the axis of rotation to adjust the pressure between the pad and cam follower;

whereby rotation of the truck and cam insert causes the cam follower to move along the cam surface in a direction along the axis of rotation and out of the insert, said movement being resisted by the resilient pad.

5. The truck assembly of claim 4, including a resilient annular shock absorbing bushing positioned between the truck and the annular insert.

6. The truck assembly of claim 4, said truck having a plurality of spaced keyways extending along the axis of rotation adjacent the aperture, said bushing having mating keys along a perimeter thereof and longitudinal keyways in the area of the keys and along an inner surface, said annular insert having keys in mating relationship with the keyways of the bushing.

7. A truck assembly for a skate-like device comprising:

A. a truck support including a mounting plate and a mounting bracket having spaced flanges and extending angularly outward therefrom;

B. a truck adapted to accommodate axled wheels and pivotally mounted to the mounting bracket between said flanges so as to define a fixed axis of rotation at an acute angle to the mounting plate, said truck having a central aperture therethrough;

C. means positioned along the axis of rotation between said flanges and resiliently engaging said truck to resist rotation of the truck, said means including a truck insert having an annular rib extending normal to the axis of rotation to divide the insert into a first and second chamber, a first resilient annular pad positioned in the first chamber against the rib and a second resilient annular pad positioned in the second chamber against the rib and means engaging said pads to increase or decrease the pressure against the rib and the respective chamber; and D. an adjustment pin extending along the axis of rotation and through the flanges, the truck and the resisting means to adjust the pressure of the pad engaging means.

8. A truck assembly for a skate-like device comprising:

A. a truck support including a mounting plate and an adjustable mounting bracket extending angularly outward therefrom, said mounting plate having a flange extending therefrom, said flange terminating in an arcuate surface having spaced teeth therealong, said mounting bracket having a flange extending therefrom terminating in a mating arcuate toothed surface, and means to tighten the mating teeth into mating engagement at the desired angular relationship;

B. a truck adapted to accommodate axled wheels and pivotally mounted to the mounting bracket so as to define a fixed axis of rotation at an acute angle to the mounting plate, said truck having a central aperture therethrough;

C. means positioned along the axis of rotation and resiliently engaging said truck to resist rotation of the truck; and D. an adjustment pin extending along the axis of rotation and through the bracket, the truck and the resisting means to increase or decrease the resilient engagement of the resisting means.

9. The assembly of claim 8, said tightening means including a bolt positioned through a slot in the mounting bracket flange and in threadable engagement with the mounting plate flange.

10. A truck assembly for a skate-like device comprising:

A. a truck support including a mounting plate and a mounting bracket extending angularly outward therefrom, said mounting plate comprising a first plate for attaching to the device and bonded to one side of a resilient shock absorbing sheet and having a plurality of apertured legs extending outward therefrom through the sheet, a second plate including the mounting bracket bonded to another side of said resilient sheet, said second plate out of contact with the apertured legs, said mounting plate adapted to connect to the device through fasteners inserted through the legs;

B. a truck adapted to accommodate axled wheels and pivtoally mounted to the mounting bracket so as to define a fixed axis of rotation at an acute angle to the mounting plate, said truck having a central aperture therethrough;

C. means positioned along the axis of rotation and resiliently engaging said truck to resist rotation of the truck; and D. an adjustment pin extending along the axis of rotation and through the bracket, the truck and the resisting means to increase or decrease the resilient engagement of the resisting means.

11. The assembly of claim 10, both of the first and second plates being interlocked and bonded to the resilient shock absorbing sheet.

* * * * *